US006041705A

United States Patent [19]

Lintner

[11] Patent Number: 6,041,705

[45] Date of Patent: Mar. 28, 2000

[54] ROTARY SILK SCREEN PRINTING MACHINE

[76] Inventor: Alexander Lintner, Liststrasse 34, A-6330 Kufstein, Austria

[21] Appl. No.: 09/147,402

[22] PCT Filed: Jun. 25, 1997

[86] PCT No.: PCT/EP97/03341

§ 371 Date: Dec. 17, 1998

§ 102(e) Date: Dec. 17, 1998

[87] PCT Pub. No.: WO98/01302

PCT Pub. Date: Jan. 15, 1998

[30] Foreign Application Priority Data

Jul. 3, 1996 [DE] Germany ..... 196 26 821

[51] Int. Cl.[7] ..... B41L 13/04

[52] U.S. Cl. ..... 101/116; 101/183

[58] Field of Search ..... 101/114, 115, 101/116, 121, 122, 123, 129, 171, 173, 181, 183, 479

[56] References Cited

U.S. PATENT DOCUMENTS

| | | | |
|---|---|---|---|
| 3,898,156 | 8/1975 | Zimmer | 101/116 |
| 4,063,501 | 12/1977 | Lotte . | |
| 4,366,542 | 12/1982 | Anselrode . | |
| 5,255,598 | 10/1993 | van Sas et al. . | |
| 5,400,709 | 3/1995 | Drilling et al. . | |
| 5,664,101 | 9/1997 | Picache | 101/183 |

FOREIGN PATENT DOCUMENTS

| | | |
|---|---|---|
| 0 396 924 | 11/1990 | European Pat. Off. . |
| 42 37 837 A1 | 6/1993 | Germany . |
| 59-71861 | 4/1984 | Japan . |

*Primary Examiner*—Ren Yan

*Attorney, Agent, or Firm*—Sixbey, Friedman, Leedom & Ferguson, PC; David S. Safran; Donald R. Studebaker

[57] ABSTRACT

A rotary silk screen printing machine or press with a modular design of the individual printing mechanisms and fully integrated control modules within a digital network system of the printing machine is set forth.

As a result of the logical, modular design of the individual printing mechanisms, on a given printing machine base with a continuous conveyor belt fixed between two main rollers and which is driven by a main drive motor, it is possible to insert, replace and reprogram individual printing mechanisms. Both during the installation of a new printing system and when reequipping existing systems, considerable technical and economic advantages arise.

14 Claims, 3 Drawing Sheets

ROTARY SILK SCREEN PRINTING MACHINE

TECHNICAL FIELD OF THE INVENTION

The invention relates to a rotary silk screen printing machine which comprises two main rollers mounted in spaced manner, one is driven by a main drive motor, a continuous conveyor belt fixed between the main rollers and a plurality of printing mechanisms succeeding one another over the course of the conveyor belt and which in each case have a printing cylinder and a printing cylinder drive associated therewith.

BACKGROUND OF THE INVENTION

Rotary silk screen printing machines of this type are e.g. known from EP 396 924 B1 or EP 522 640 A1.

Drive technology for rotary silk screen printing machines, has envolved over the last five to ten years, to include the use of individual motors for positioning and driving the individual printing cylinders and associated therewith the increasing use of electronic drive components. In the early stages of this development machines of this type equipped with stepping motors individually associated with the printing mechanisms (cf. EP 396 924 B1) were only developed as top of the line products in addition to the known, so-called geared machines and were gradually provided with additional different electronic functions, in order to take account of the general trend towards automation. This new, individual drive technology developed rapidly to form the general standard, so that presently purely mechanical machines have almost disappeared from the market. Also printing machines with a low degree of automation nowadays have in a virtually obvious manner this technology developed as "single drive technology". This is technically implemented by the use of stepping motors or servomotors, equipped with the necessary electronic control or setting for ensuring an adequate synchronous running and a corresponding degree of automation, also through the incorporation of additional actuators, sensors and operating means, together with service and control elements for each individual printing cylinder, which must be electrically connected by means or a large number of cable connections with the generally separately set up control means often several metres away. Even though the comprehensive equipping of each printing station nowadays simplifies and facilitates the production of material to be printed, there are still numerous practical difficulties and disadvantages.

As printing systems of the aforementioned type must generally be equipped with more than ten printing stations, the manufacture, fin situ installation and in particular the subsequent maintenance prove very costly and difficult, so that only specially trained experts are able to study, handle and maintain such systems. Such high capital costs for the operator of such systems must be added additional extra expenditure for installation, commissioning and continuous servicing by expensive specialists. This clearly runs counter to the requirement for highly productive capital products resulting from competition and high costs, which permit the production with low running costs, maximum quality standards and minimum maintenance-caused production shutdowns.

SUMMARY OF THE INVENTION

The object of the present invention is to provide a rotary silk screen printing machine which, in the case of low capital expenditure, is rapidly and easily adaptable to modified production requirements and which permits a high degree of machine usage.

In the case of a rotary silk screen printing machine of the aforementioned type, this object is achieved in that the printing mechanisms are implemented by modular single subassemblies with in, each case associated control modules individually programmable to different printing programs, each case is connectable to a data bus of the printing machine in digital network interconnection for the interchange of operating parameters between the control module on the one hand and the conveyor belt drive unit or units on the other, while the control modules are interconnectable and/or connectable to a command station.

Thus, the invention is based on the idea of modularizing a rotary silk screen printing machine in all its stations as outwardly autarchic, completely standardized submachines, which can be separately developed, built up, produced, tested and maintained, so that all production variants are possible in random manner by a different combination of such modular components. Through such a consideration of the problem directed the individual printing stations it is in particular possible, even for relatively technically unskilled persons, to make available a complete, overall highly complex printing system, which can be relatively easily monitored and easily handled during manufacture and subsequently in situ.

Such a modular system also permits a simple conversion of existing production systems with rotary silk screen printing machines to the new modular technology, which is of increasing significance in view of the worldwide trend towards standardization. Thus, a less costly adaptation compared with a complete new investment permits the more efficient use of already existing resources, equipment parts, etc. and the exclusive renewal of process-relevant parts of a system is consequently made realistically and inexpensively possible for the first time.

Advantageously the operating parameters for the individual printing stations can on the one hand be produced by preset values in a memory of a CPU within the control module and on the other can be fixed by a previously defined protocol for a specific printing program supplied by means of the data bus and an interface in the control module.

Further advantageous embodiments of the present invention will become apparent to those skilled in the art from the following detailed description.

An embodiment of a rotary silk screen printing machine in accordance with the present invention is described in greater detail hereinafter in a non-limitative manner with reference to the attached drawings.

Corresponding components and subassemblies are given the same reference numerals throughout the drawings.

Figure 1:
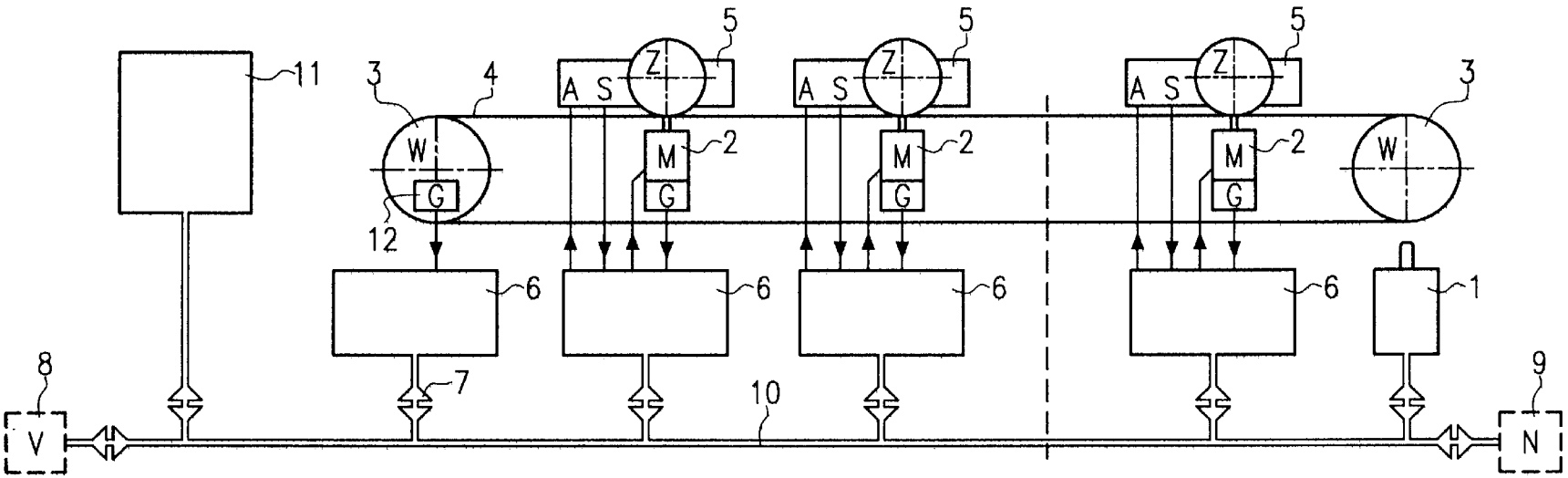
FIG. 1 is a schematic illustration of a rotary silk screen printing machine with individual printing stations or mechanisms in association with a typical printing machine base structure with a continuous conveyor belt travelling round two main rollers.

FIG. 1 illustrates in simplified form the typical structure of a rotary silk screen printing machine or press. Between the spaced main rollers 3 is fixed a continuous conveyor belt 4, often also known as a printing blanket, which is driven at one end by a main drive motor 1. Within the framework of the inventive concept of a modular construction of the individual printing stations, ideally use is made of a drive for the continuous conveyor belt 4, which has an integrated, digital interface to a network data bus 10. A digital primary element 12 present in known manner on one of the main rollers detects the movement and position of the continuous conveyor belt 4.

The individual printing mechanisms 5, marked by the sequential ordinals "1", "2", . . . "n", have in each case distributed control modules 6 which, as shown, are connected by means of a multipole plug connection 7 and optionally also by other, e.g. optoelectronic coupling sections, to the network data bus 10. It is optionally also possible to incorporate functionally into the network data bus 10 one or more command stations 11 as central display, control and operating units for a machinist and optionally also upstream or downstream equipment parts 8, 9.

The structurally identical, distributed control modules 6 of the individual printing mechanisms 5 are so programmed that by combining generally relevant data available via the network data bus 10, the number of connected stations, speed and position of the conveyor belt 4, etc., together with the different states determined by sensors S and operating means A present on the individual stations, precisely that specific information is available via the network data bus 10, which is permanently required for a specific printing station and for a completely satisfactory production sequence.

It is stressed that unlike in the known solutions (cf. EP 396 924 B1), there is no need to transmit any central pulse frequencies as synchronizing signals from a master computer to the individual printing mechanisms 5 or printing stations. As a result of the present invention, only purely binary information is exchanged in encoded form within the network data bus 10 between equal-rank control modules 6 in accordance with a previously defined protocol giving all the already mentioned control quantities and states. The interface at the individual control modules to the network data bus 10 can be in the form of a known, widely used standard interface, e.g. that according to standard RS485. It is obviously conceivable to use other, further definable interface standards and this may be advantageous in individual cases.

Figure 2:
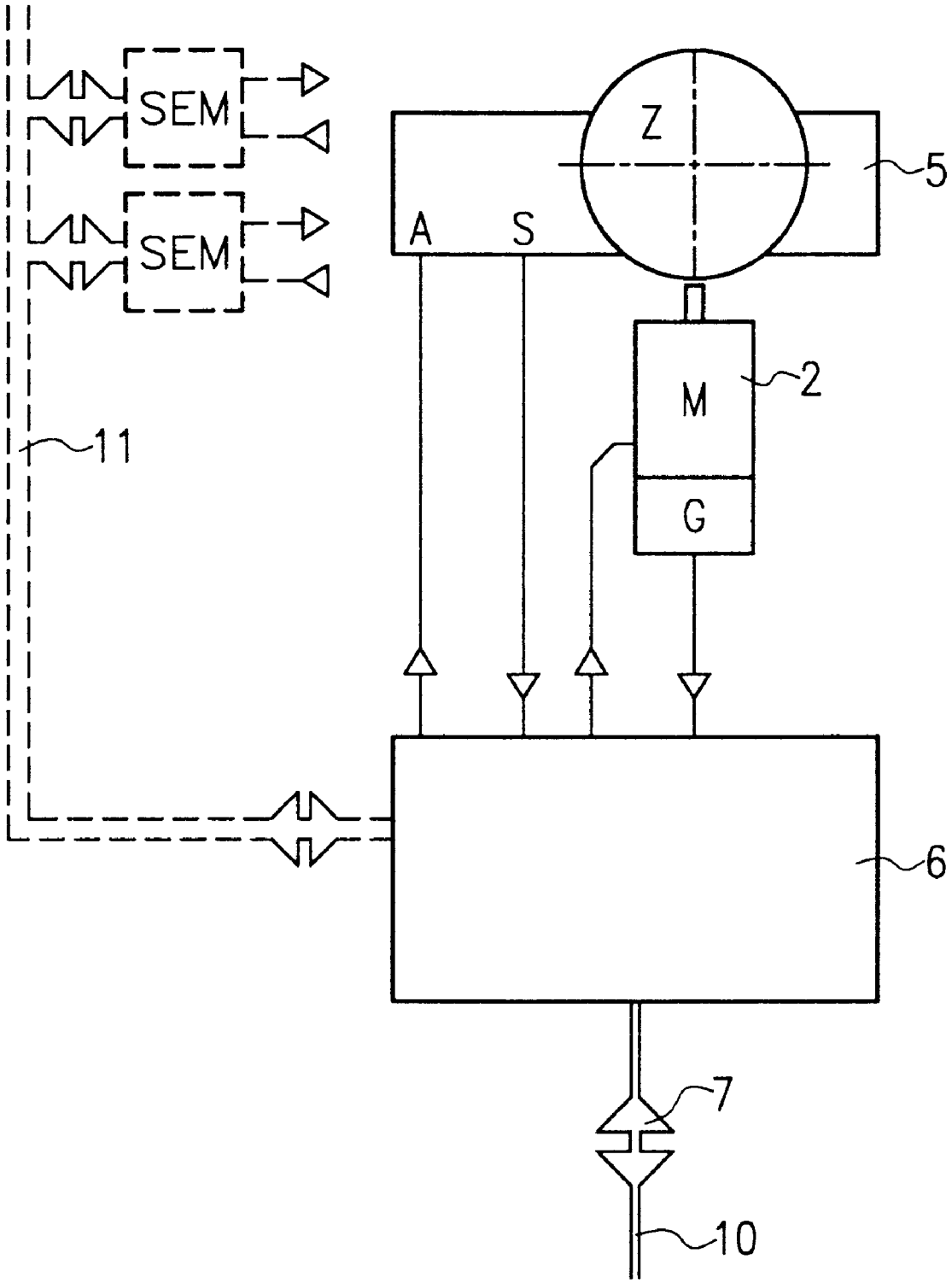
FIG. 2 is schematic illustration of an individual submachine, i.e. the printing station with printing roller drive, various sensors and operating means, as well as a printing station-internal subnetwork.

FIG. 2 shows in exemplified manner the structure of a single, modular printing station comprising the printing mechanism 5 with printing cylinder Z and various sensors S required for the control of a smooth printing sequence, such as the determination of the longitudinal, transverse and diagonal register position of the printing cylinder, the necessary vertical position of the printing mechanism over the substrate to be printed, the tension of the printing cylinder and the temperature detection at important units and operating means A for the automatic performance of the transverse, diagonal and vertical movement of the printing mechanism and e.g. for controlling solenoid valves for the pneumatic control circuits in the printing mechanism, the printing cylinder drive 2, which is preferably a stepping motor with integrated position determination and the control module 6. The use of other motor types suitable for such an operation, such as e.g. a.c. or d.c. servomotors is also conceivable. A subnetwork 11, provided for possible extensions, permits the simple inclusion of further additional subassemblies to be integrated into the printing station, without interventions being necessary in the hardware of the control module 6. FIG. 2 shows in exemplified manner two electronic submodules SEM, whose function is not significant here.

Figure 3:
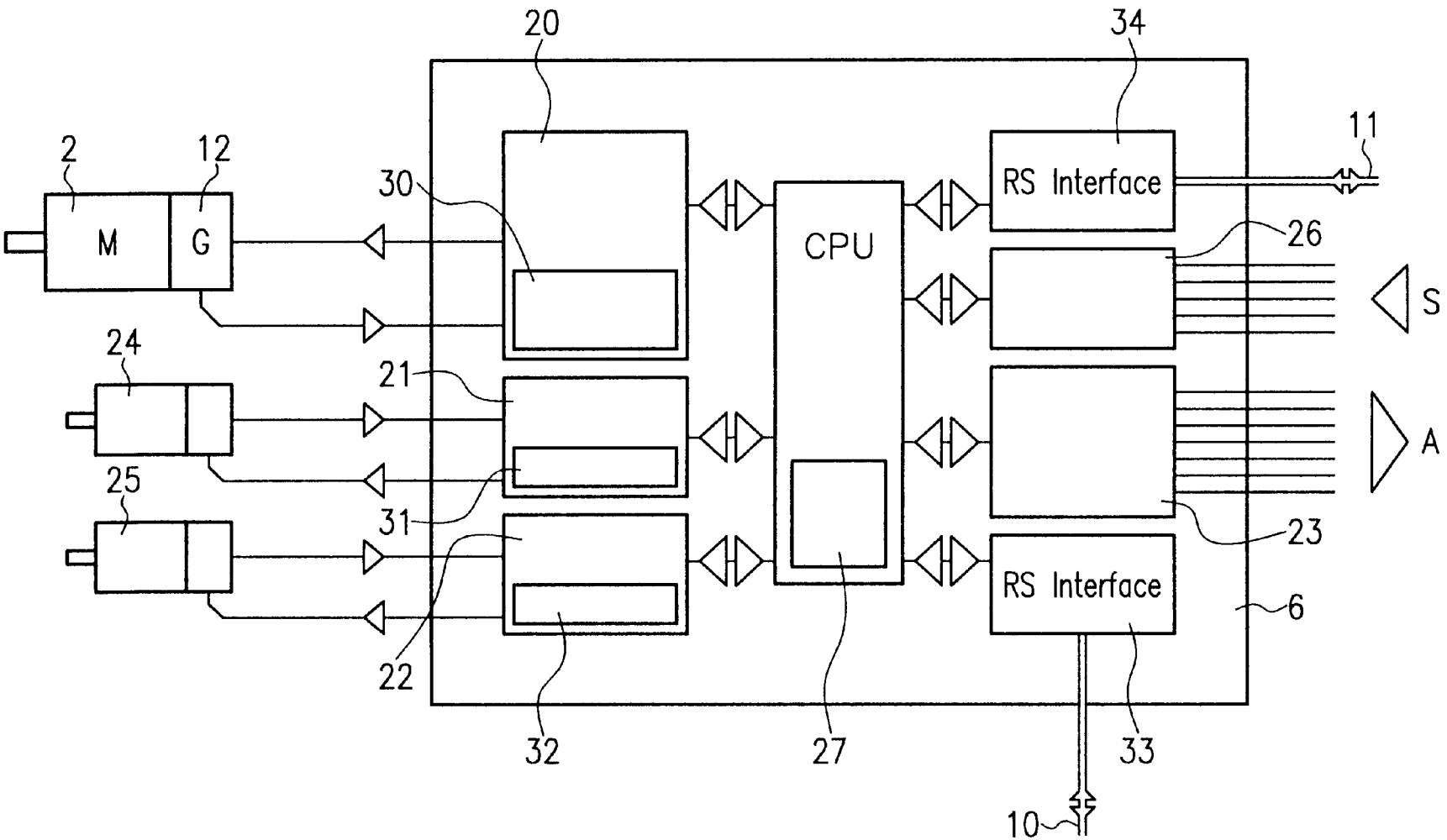
FIG. 3 is a block circuit diagram structure of a, distributed control module for supplying typical components of a printing station, such as printing roller drive, servodrives, sensors and operating means in accordance with the present invention.

The structure of the control module 6 is illustrated in FIG. 3. An integrated microcomputer CPU controls several power drivers 20, 21, 22, 23 for the printing roller drive by means of the drive motor 2, servodrives 24, 25 and various operating means A. Part of the operating means A in the form of servodrives 24, 25 implements the aforementioned, automatic movements of the printing mechanism and it is carried out by means of an integrated position determination 30, 31, 32 to re-determine the position actually reached independently of possible impressions of the mechanism using suitable sensors S.

The system of the control module 6 is able to poll tie states of connected sensors 5 by means of the inputs of an integrated data acquisition component 26. The software necessary for an inventive, autarchic operation of the control module 6 is contained in a flash memory 27 and is immediately available when the supply voltage is applied. Only the individual basic programming for a specific printing process and subsequently possibly necessary program changes are carried out by means of the network data bus 10. For connection to the network data bus 10 and to the subnetwork 11, the control module 6 has in each case a RS interface 33, 34.

The following will be apparent to one skilled in the art on the basis of the description of an embodiment provided herein above. The base of a rotary silk screen printing machine, which essentially comprises the two main rollers 3 and a continuous conveyor belt 4 for conveying the material to be printed, must be produced so-to-speak as a "fixed component" together with varying numbers of printing stations, in order to provide a complete printing machine. Appropriate control equipment must be produced and installed in situ for a production-specific arrangement of the printing stations on the base as from this time.

The invention leads to the advantage that a printing machine can be so structured that a random number of printing stations in the form of already completely functional autarchic components, each provided with all the mechanical, electrical and electronic subassemblies can be combined to form a printing machine by simply "mounting" on a corresponding base, which merely takes over the function of a conveying or transportation unit. The interaction of the individual printing mechanism necessary for a smooth printing process sequence is ensured by the linking of the individual modules by means of a purely digital data network, which subsequently allows a rapid and easy addition or removal of individual printing stations in a very short time and without special aids. As a result of the present invention, there is no need for a central or partially central control equipment, as is at present generally conventional, and known and required.

As stated, such an arrangement built up from individual, modular printing stations is made possible by highly integrated, electronic control modules, which in the most confined possible space, permits the housing of the necessary control intelligence, all the power drivers for motors and operating means, supply circuits and for the interlinked, necessary, digital communications interfaces directly in the individual printing station as a fixed component thereof. As a result of such a completely decentralized arrangement, in which the individual printing stations are merely linked to form a chain suitable for printing production by the connection of the power supply and network data bus, widely varying variants of a printing line can be implemented without the manufacture of project-specific subassemblies.

This leads to the following advantages: A base frequently already in the hands of customers by merely equipping with the inventive, individual printing stations becomes a specific printing machine, which can subsequently, optionally be rapidly and easily adapted to modified production requirements.

All the components necessary for the operation of a single printing station are redundantly present due to the completely distributed or decentralized structure, i.e. in the case of a fault this can only bring about the failure of a specific printing station, but never the complete printing machine. A total shutdown, such as e.g. occurs if a master computer fails in known printing means, is excluded by the present invention.

Individual printing stations can be easily extracted from the overall arrangement for service or repair purposes and the latter can be carried out at a location remote from production, without having to render inoperative the complete printing machine. It is appropriate and possible in such cases to keep available one or more reserve stations, which can be used in a very short time and can be set up for the particular printing process by a rapid, digital data exchange.

The rotary silk screen printing machine according to the invention has an overall modular construction. The above description shows that the individual modular printing stations or printing modules in each case have a printing mechanism and a control unit. The control unit is constricted as a control module, which is placed in an easily replaceable manner on one outside of the printing module. The control module can be connected by means of easily detachable fastening means, such as screws and connecting plugs to the respective printing module. In addition, all the control modules on the rotary silk screen printing machine have an identical construction, so that they are mutually interchangeable. Thus, in the case of a failure of a control module, it can be rapidly replaced by a reserve control module or a control module of an unused printing module.

Preferably the control module has a watertight casing, so that also on replacing a control module damage by penetrating water can be prevented. The connecting plugs to the printing mechanism are also constructed in watertight and dampproof manner.

To facilitate the installation of the printing modules, according to the present invention the base carries in fixed manner reception devices for the printing modules. The number of reception devices is a function of the length of the conveyor belt and corresponds to the maximum number of printing modules to be provided. The reception devices can be holding plates with centering pins, on which can be mounted or slid in a precisely defined position and in accurately fitting manner a printing head. Fixing can optionally take place by locking screws or other appropriate fastening means. It is also possible to provide identification markings on the reception devices, by means of which the control module can establish on which of the reception devices the printing module is fitted.

Another preferred embodiment of the present invention comprises the main drive motor being constructed as a module, which as independent of the rotary silk screen printing machine base. The driven shaft of the main drive motor is connected by means of an easily releasable shaft connection, e.g. a flange connection, to the main roller for the drive of the conveyor belt. The flange connection can be constructed as a compensating coupling for compensating a shaft misalignment and/or as a shearing pin coupling for overload protection purposes.

The main drive motor module is constructed a in pallet-like manner in its base area, so that the main drive motor can be easily removed from the rotary silk screen printing machine, e.g. by a forklift or a lifting truck, following the release of the flange connection.

Thus, in a relatively short time the motor can be replaced for maintenance or repair purposes by a reserve motor.

As a result of the logical modular design of the rotary silk screen printing machine according to the invention shutdown times caused by maintenance and repair can be significantly reduced. The inventive rotary silk screen printing machine consequently not only has a simple and service-friendly, maintenance-friendly structure, but also allows particularly economic production.

While the present invention has been described with reference to a preferred embodiment, it should be appreciated by those skilled in the art that the invention may be practiced otherwise than as specifically described herein without departing from the spirit and scope of the invention. It is, therefore, to be understood that the spirit and scope of the invention be limited only by the appended claims.

I claim:

1. Rotary screen printing machine for a printing process comprising:

a base having two main rollers mounted in a spaced relationship to one another, a conveyor belt fixed between said main rollers for conveying a substrate to be printed, and a main drive motor for one of the main rollers;

a plurality of printing stations successively arranged along said conveyor belt, each of said printing stations having a printing mechanism including a printing cylinder and a printing cylinder drive, each of said printing stations being a mechanically and electronically autarchic printing module with each having an individual control module, a printing process control for controlling the printing process with said individual control modules of each of said printing modules alone controlling the printing process; and a network data bus connected to which each printing module for data exchange between said individual control modules;

wherein control of the printing process is a distributed control, which is formed by the control modules of the printing modules and the printing process is exclusively controlled by the control modules of the printing modules.

2. Rotary screen printing machine according to claim 1, further comprising a CPU having a memory wherein operating parameters are fixed by preset values in memory of the CPU within each control module and by a protocol for a specific printing program supplied by the network data bus and an interface in each control module.

3. Rotary screen printing machine according to claim 1, wherein the control modules are connected to a drive unit of the conveyer belt.

4. Rotary screen printing machine according to claim 3, further comprising a pilot station wherein said control modules are connected to the pilot station.

5. Rotary screen printing machine according to claim 2, further comprising a pilot station wherein said control modules are connected to the pilot station.

6. Rotary screen printing machine according to claim 1, where each printing mechanism includes at least one position determination sensor, at least one operating means for position correction and associated position determination and, on a drive side, an angular position generator, signals of which pass as input signals into the control module.

7. Rotary screen printing machine according to claim 1, wherein the control modules are connected to a drive unit of the conveyer belt.

8. Rotary screen printing machine according to claim 7, further comprising a pilot station wherein said control modules are connected to the pilot station.

9. Rotary screen printing machine according to claim 6, further comprising a pilot station wherein said control modules are connected to the pilot station.

10. Rotary screen printing machine according to claim 7, wherein the control modules are connected to a drive unit of the conveyer belt.

11. Rotary screen printing machine according to claim 10, further comprising a pilot station wherein said control modules are connected to the pilot station.

12. Rotary screen printing machine according to claim 1, further comprising a pilot station wherein said control modules are connected to the pilot station.

13. Rotary screen printing machine according to claim 7, wherein said control modules have an identical structure and are constructed as equal-rank control units.

14. Rotary screen printing machine according to claim 7, wherein a variable number of printing modules are provided and which are universally fitted and removed from said base.

* * * * *